US005673496A

United States Patent [19]

Wegner et al.

[11] Patent Number: 5,673,496

[45] Date of Patent: Oct. 7, 1997

[54] DRY CHARGE MACHINE AND METHOD

[75] Inventors: Paul C. Wegner, San Carlos; Ralph G. Tiegel, Redwood City, both of Calif.

[73] Assignee: Tiegel Manufacturing Company, Belmont, Calif.

[21] Appl. No.: 591,491

[22] PCT Filed: Apr. 10, 1995

[86] PCT No.: PCT/US95/03936

§ 371 Date: Jul. 18, 1996

§ 102(e) Date: Jul. 18, 1996

[87] PCT Pub. No.: WO95/27878

PCT Pub. Date: Oct. 19, 1995

[51] Int. Cl.[6] ..... F26B 3/00

[52] U.S. Cl. ..... 34/471; 34/219; 34/474

[58] Field of Search ..... 34/219, 471, 475, 34/477, 517, 235

[56] References Cited

U.S. PATENT DOCUMENTS

| | | | |
|---|---|---|---|
| 2,732,631 | 1/1956 | Black | 34/219 |
| 3,413,728 | 12/1968 | Tiegel et al. | 34/219 |
| 4,099,337 | 7/1978 | Wauhop, Jr. | 34/474 |
| 5,040,974 | 8/1991 | Lanham et al. | 34/219 |

*Primary Examiner*—John T. Kwon

*Attorney, Agent, or Firm*—Frank J. Benasutti

[57] ABSTRACT

The dry charge machine and method disclosed carefully monitor the temperature above and below the plates as well as the water temperature exiting the machine and introduce cooling water at a flow rate and temperature so as to maximize thermal efficiency in drying and minimize the energy necessary to raise the temperature of the drying gas. The machinery is arranged and controlled so that water droplets are not introduced into the air. Oxygen leakage into the machine in minimized and the oxygen content of the air is monitored.

35 Claims, 9 Drawing Sheets

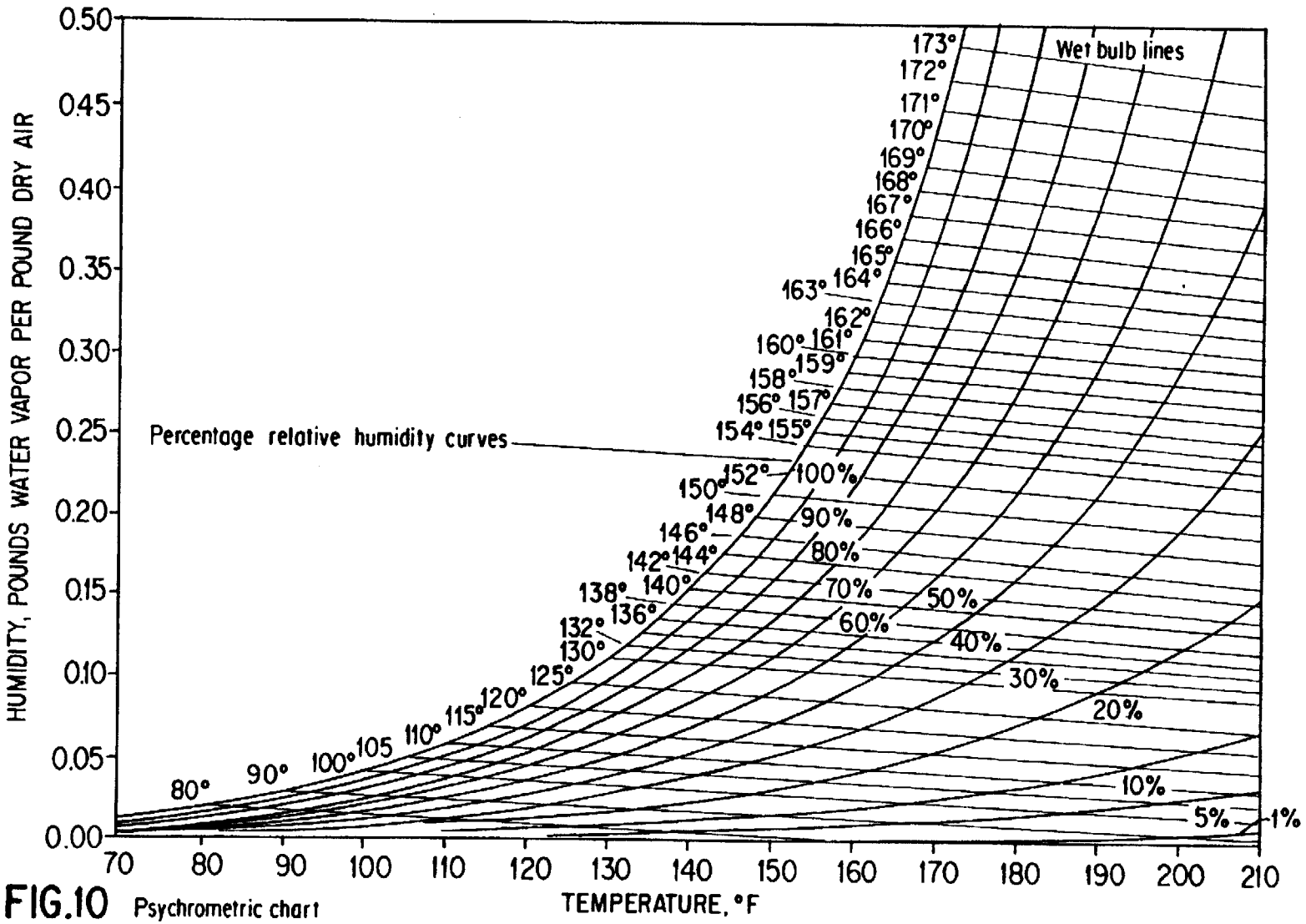
FIG.10 Psychrometric chart

DRY CHARGE MACHINE AND METHOD

TECHNICAL FIELD

This invention relates to improvements in the means for and methods of making dry charged battery plates, and in particular, to the apparatus and process for drying previously charged battery plate groups.

BACKGROUND ART

The prior art to which this invention relates is best illustrated in the United States Patent issued to E. G. Tiegel et al., U.S. Pat. No. 3,413,728 dated Dec. 3, 1968. Prior art FIGS. 1, 2, and 3 illustrate this machine and the method of using it. With reference to those drawings and the specification of that patent it will be noted that in operation the door 13 is opened and a basket 20 containing battery plate groups is lowered into a drying chamber 18. When closed, the door 13 relies upon a gasket around its periphery to maintain a seal.

A centrifugal fan 41 receives hot combusted gases from a combustion chamber 38 and mixes it with intake air which it then blows down the sloping surface in the direction the arrows shown over the charged plates. The hot air passes through the basket and thence through a support means 19, and through a baffle means 28 and into a cooling chamber 25. Within this cooling chamber a spray nozzle 27 sprays water into the air. The baffle 28 is designed to prevent the mist from that spray from going back up-stream in the air flow.

The hot air with entrained water continues in a clockwise direction and passes through a mist eliminator 39; which is in the form of a wire screening which removes the physical water droplets. It then re-enters the collecting and pre-mixing chamber 37 and becomes part of the intake air through the fan 41. An exhaust duct 44 is provided with a damper valve 47 ostensibly to maintain positive pressure. It is stated that the pressure in the chamber 37 is above-atmospheric.

Intake air is supposedly controlled by the temperature of the exhaust gas in duct 43.

The specification states that in its method form, the invention generally comprises the steps of placing charged batteries or plates in a drying chamber, providing a stream of substantially oxygen-free drying gas by mixing cold, substantially oxygen-free air at high humidity with hot, substantially oxygen-free combustion gases and passing the stream of drying gas through the drying chamber containing the battery plates to be dried. It states that the drying gases should be of a relatively low temperature to avoid injury to the charged battery plates; preferably not more than about 200° Fahrenheit or less; the preferred range being about 100° Fahrenheit to 250° Fahrenheit, and preferably the temperature will be adjusted in the range of 170° F. to 185° Fahrenheit. The specification states that the apparatus can be regulated accurately at 180° Fahrenheit if desired.

Prior art machines of this type have been manufactured and sold by the Tiegel Manufacturing Company of Belmont, Calif. In the real world, the Tiegel dry charge machined operated at 180° F. or less.

SUMMARY OF INVENTION

We have redesigned this machine both conceptually and structurally to provide a greatly improved apparatus and method for making dry charged plates.

The essence of the present invention is that the energy input in the form of heat is controlled by both the apparatus and the process, to provide maximum thermal efficiency. Heat is used primarily to dry the plates and minimally to reheat the air from the heat (temperature) loss due to the condensation process. In the prior art, the apparatus and method, as exemplified by the Tiegel machine, used too much cooling, that is, more than what was needed. That machine used a spray nozzle, as well as very cold water. The spray nozzle caused high surface area water droplets which not only transferred heat quickly, but also created problems in that they were transferred to the plates, thereby lengthening the time it took to dry them. This created a need for even more BTU to bring the machine up to temperature.

By the method, heat is used to remove the moisture from the plates and to bring the temperature from approximately 157° F. back up to 200° F. In the prior art Tiegel method, heat was used to remove the moisture from the plates and to bring the process air temperature to 180° F. from 120° F.

In this new method, the heat which is used for drying the plates reduces the temperature in the air from 200° F. to approximately 160° F. An additional three degrees is used for cooling to remove the moisture from the air. Then it is brought back up to the process temperature of 200° F. This three degrees is the only loss; that is, the only inefficiency. It is defined as a loss because it does not contribute to evaporating moisture from the plates. In accordance with the present invention, the apparatus and method uses forty degrees of temperature change to do useful work, and three degrees that does not do useful work. Thus the thermal efficiency is approximately 90%.

As a practical matter, the Tiegel machine went from 180° F. to 160° F. during the drying process, and then 160° F. to 120° F. during that portion of the process which cooled the air. Thus, the prior art machine had a forty degree temperature drop; which was wasted energy. Its thermal efficiency was twenty degrees for useful work and forty degrees of wasted work for total energy consumption of 60 degrees. Its thermal energy efficiency, therefore, was twenty divided by sixty, or 33%.

Furthermore, because Tiegel kept re-introducing moisture into the plates, it took that machine an extended period of time to dry those plates. In actual tests, it appears that the time elapsed by the new machine is three times as fast as the time used by the Tiegel machine. Thus, on a comparative thermal efficiency basis, the prior art Tiegel machine has a comparative thermal efficiency of 11%. Some of the differences from the prior art dryer are as follows:

1. No spray nozzles, means not re-introducing water via droplets into the process.
2. No mist eliminators, means decreased back pressure.
3. No baffles, means decreased back pressure.
4. Higher thermal efficiency.
5. Plates which are dryer.
6. Lower oxygen levels in the plates.
7. Automatic drying to desirable moisture level in the plates.
8. No moving damper on the stack.
9. No freon temperature bulb.
10. An insert oven.
11. Improved flame rod.
12. Automatic pilot.
13. Automatic loading/explosion door.

The main advantages of the new dryer are:

1) reduced operating cost, which would be approximately the following:

| | OLD | NEW | ANNUAL SAVINGS (200 workdays/ 8 hr. day |
|---|---|---|---|
| ELECTRICAL/HR | 28 KW | 3.0 KW | |
| | $4,480 | $480 | $4,000.00 |
| GAS BTU/HR | 450,000 | 150,000 | |
| | $3,600 | 1,200 | $2,400.00 |
| COOLING WATER/HR | 900 | 420 | |
| | $1,440 | $672 | $728.00 |
| | | TOTAL SAVINGS | $7,128.00 |

Notes:
Electricity at 10 cents per KW hr.
Gas at 50 cents per 100,000 Btu
Water at $1.00 per 1000 Gallons
Minutes to dry industrial plates: Old 150. New 45.

Since the process is three times faster, the total savings per machine per year would by $21,384.00.

2) Higher reliability:

By measuring the temperature entering the plates and leaving the plates, dryness can be determined. A return temperature sensor determines if the cooling water is adequate in flow and/or low enough in temperature to remove sufficient moisture from the air before reheating. This allows just the right amount of cooling to be used throughout the drying process.

If a cooling tower is used, the fan is turned on only when increased flow does not produce enough cooling, and lower water temperature is required. Another method is to automatically blend the hot with the cold water coming from the cooling tower.

3) A safer machine:

The loading door is the explosion door which opens up, rather than to the side, as in the old style machines. In addition, the loading door is opened and shut with a pair of air cylinders (one located on each side). This prevents the door from flying open freely.

The flame monitoring is done under microprocessor control that opens the door when the flame rod detects a loss of flame. Therefore, the door is opened before an explosive condition can be created. Traditionally, when flame failure occurred, both combustion gas, and air were turned off immediately. This created an accident waiting to happen, because the combustible gasses were still in the oven. Therefore, the instant oxygen diffused into the firebox, an explosion or flash fire would occur. This would occur by just waiting long enough or by opening the explosion or loading door.

The Tiegel machine actually has a special solenoid to insure rapid air shut off. The new approach turns off the gas and flushes out the fire box with air before combustible gases have a chance to accumulate in the fire box. This is done by opening the combustion air to full open. At the same time, the loading door is opened to eliminate the containment necessary for an explosion.

4) Reduced maintenance by the elimination of many parts:

The new machine does not have the following parts:

Mist eliminator screen: In areas with hard water, this screen would build up with calcium deposits that would have to be removed by soaking in hydrochloric acid annually. There was a pressure switch to indicate if the mist eliminator was flooding due to deposits of water or calcium.

Damper: This would stick over time. Also there was a sensor for this on the prior art machine. The new machine has no exhaust damper—only a short exhaust port that maintains positive back pressure, due to its restricted diameter.

Spray Nozzles: There are no spray nozzles to clog, corrode, or wear out.

Pressure Regulator: No pressure regulator is required to control flow. This is done with a motorized valve.

Baffle plate: None is required because no water droplets are formed with the new cooling process.

Fault finder to identify what failed: No fault finder is required because of the new flame control whereby, upon loss of gas or combustion air, a warning light comes on.

Separate Explosion door: There is no separate explosion door or explosion door indicator switch. The loading door does double duty.

Loading door latches: There are no loading door latches, because of reduced box pressure; reduced from 15" down to a range of 1.25 to 2.5" water column. Pressure must be positive to prevent oxygen inflow. The air cylinders that open the door also act to hold the door shut during plate drying.

Pilot button: No pilot button or manual gas valve, because the machine automatically establishes a pilot.

5) Other features:

My new insert oven comes in two parts: either one, or both, can be replaced in a matter of hours. The old machine required one to jack hammer out the old brick, re-brick, and allow the cement to cure. This process could take several days to weeks if the labor was not readily available.

The old machine used a mercury bulb to monitor temperature, which would leak from time to time. The new machine has a thermocouple probe.

The low wind velocity of the new blower is below 20 mph, so the loading door can stay open during purge with the main blower running.

An automatic cooling control automatically turns on the cooling tower pump and/or fan to meet cooling needs.

A lower loading height that meets OSHA requirements for lifting baskets

Smaller components are needed to run the machine, e.g.:

| OLD | NEW |
|---|---|
| 30 horsepower main blower | 3 horsepower main blower |
| 30 horsepower motor starter | adjustable frequency AC drive |
| 100 amp circuit breaker | 10 amp circuit breaker |
| 1 horsepower water pump | gravity feed |

6) Process improvements:

The new dryer achieves the same drying time with much less energy.

The Tiegel patent contains two false assumptions: first, that air can only be sufficiently cooled to remove moisture with the high surface area water droplets that the spray nozzles provide. In addition, it failed to recognize that if you cool the air beyond a certain point, you waste heat making hot water and do not hasten the drying process significantly. The spray nozzles created many problems whose solution created ever higher demands for electrical power. The same drying can be achieved merely by cooling with a thin film of water that flows from the rear of the machine to the front of the machine. It was also found that if the water flowed too quickly, the drying time lengthened rather than shortened.

Because no water droplets are formed, none can be blown about and reintroduced onto the plates. All the components needed to deal with the water drops created by the spray nozzles have been removed, such as the mist eliminator and baffle plate.

The back pressure dropped from 15 inches to 2.5 inches.

A prototype machine incorporated a new high cfm (cubic feet per minute) low pressure design. The basket was redesigned to eliminate wind blockage while maintaining strength. This dropped the pressure even further, down to 1.25 inches. The horsepower required to move a given cfm varies with the cube of the back pressure (static pressure). Thus, if the back pressure doubles, the horsepower needed for the same cfm increases four fold.

At the air flow being used, the air comes in to the plate at 200° F. and leaves at 160° F. If the exit temperature rises above 160° degrees, it means that the amount of moisture remaining is very little or there is insufficient cooling. There is just as much moisture in the air before and after going through the plates. If the temperature is much below 150° F., the air is very dry, but the drying is slowed, because most of the moisture is recondensing on the plates before leaving them.

The temperature of the air just before reentering the blower to be mixed with hot combustion air, should be about 153° to 157° F. This indicates that moisture removal from the air is adequate.

If the exit water temperature of the cooling water is 140° F., significant increases in drying time are noticed. If the temperature is at or about 115° F., the cooling is just enough. Otherwise, it is just a waste of cooling capacity and heat. Therefore, by measuring the cooling water temperature entering and leaving the machine and its flow rate the amount of heat leaving the dryer via the water can be determined. Per experiments, the temperature entering is 85 F. and leaving is 115° F., with a flow rate of water which is modulated to keep the water leaving at 115° F.; on the average this is 10 gallons per minute (gpm). This translates into a heat transfer of about 140,000 Btu per hour to the water.

The following elements are also inventive, as will become apparent from the previous and following descriptions with reference to the accompanying drawings: cooling with a falling film of water that has no droplets formed; drying which insures efficient use of energy, while maintaining high plate quality; and an insert oven, which reduces down time for maintenance and allows only the damaged half to be replaced, instead of having to unnecessarily replace both halves of the oven.

DISCLOSURE OF THE INVENTION

BRIEF DESCRIPTION OF DRAWINGS

FIG. 10 is a psychometric chart; and

DESCRIPTION OF THE PREFERRED EMBODIMENTS

Figure 1:
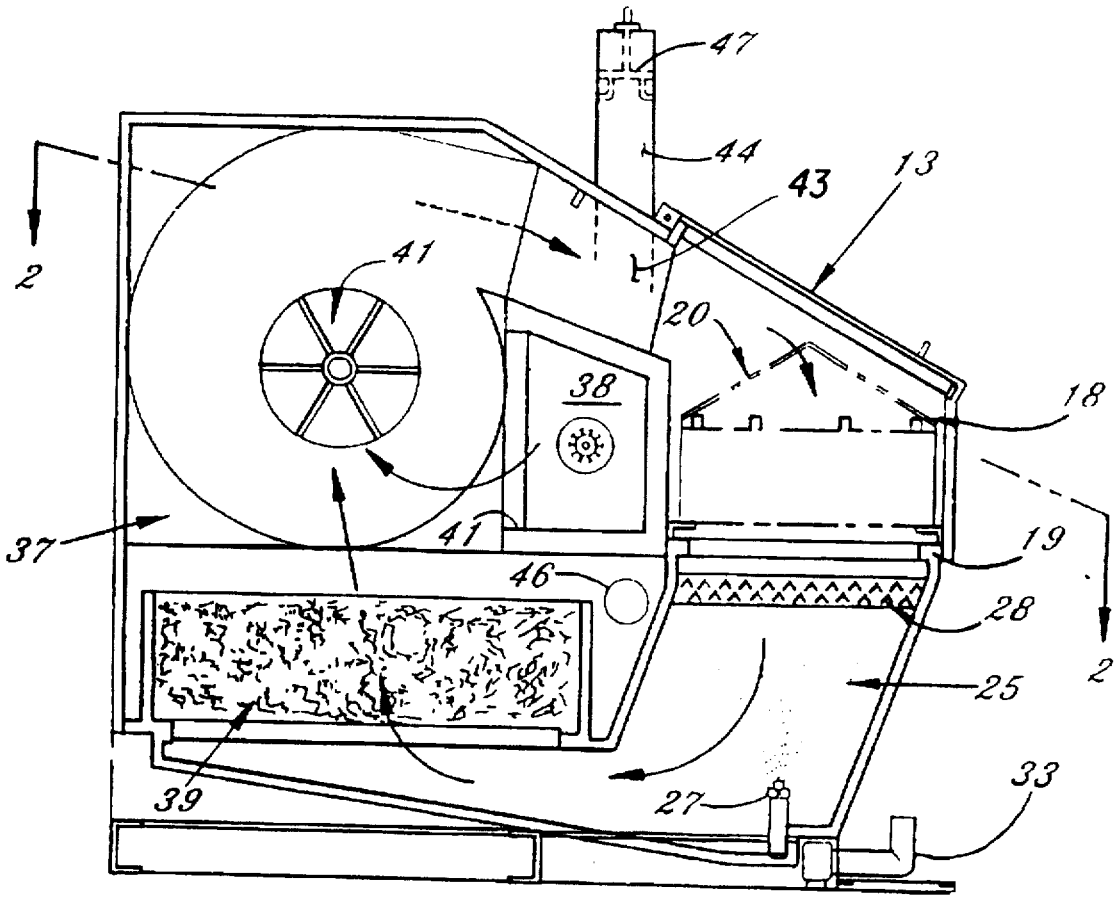
FIG. 1 PRIOR ART
FIG. 1 is a drawing from prior art U.S. Pat. No. 3,413,728 showing a vertical section taken through the machine described in said patent, substantially in the plane taken as indicated by the lines and arrows 1—1 in FIG. 2.
Figure 2:
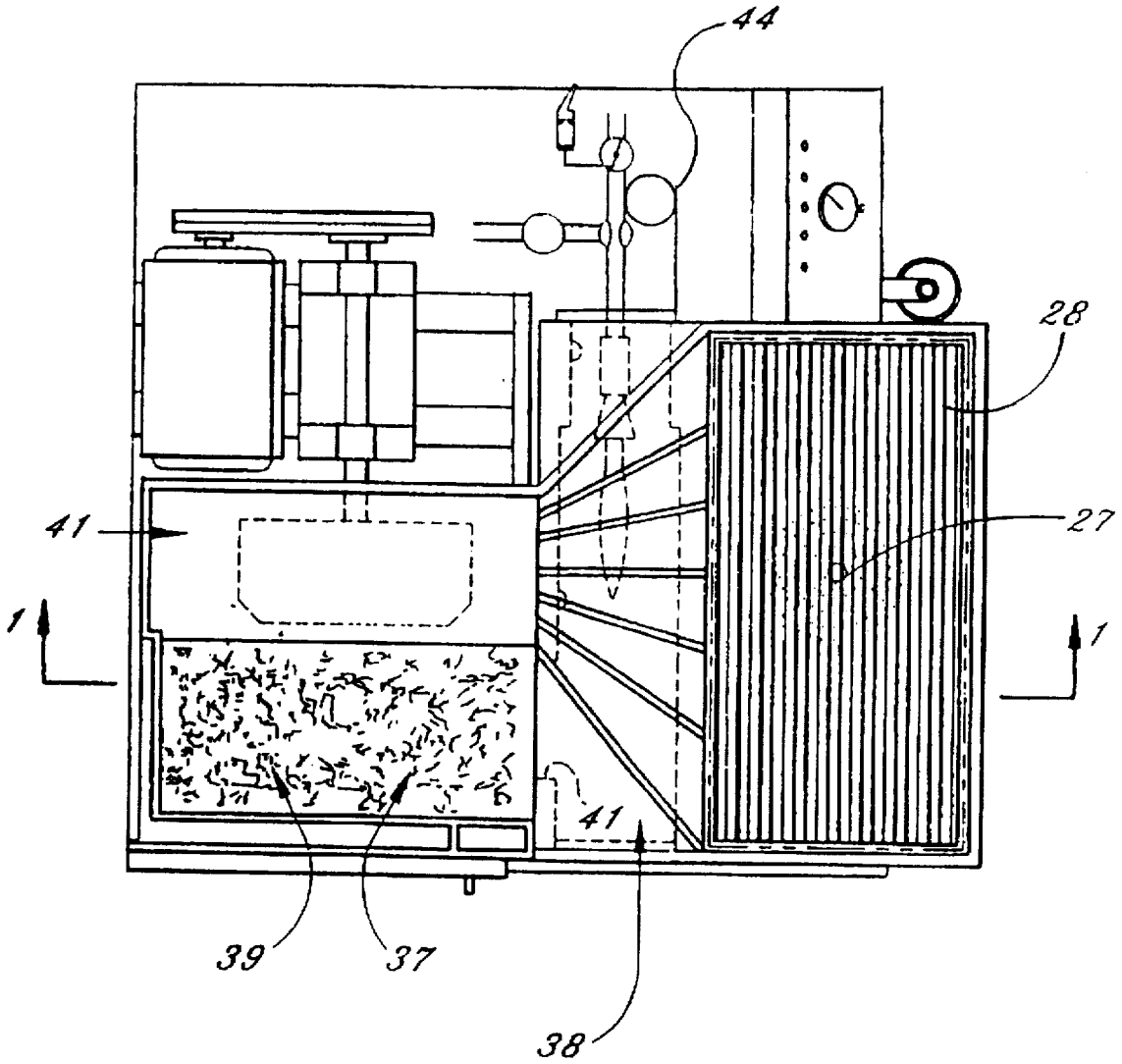
FIG. 2 PRIOR ART
FIG. 2 is a top section view of the machine shown in FIG. 1 with the cover removed in order to illustrate internal parts; the view being indicated as taken by the lines and arrows 2—2 in FIG. 1.
Figure 3:
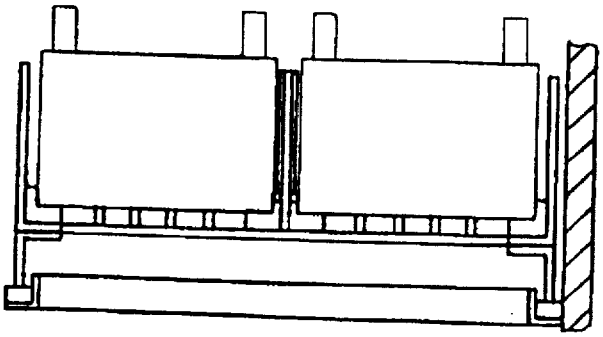
FIG. 3 PRIOR ART
FIG. 3 is an enlarged cross-sectional view illustrating in greater detail the placement of charged battery plates in the apparatus as shown in the prior Figures.

Referring to the Figures, the invention comprises structural elements which are shown in FIGS. 4 through 9, namely there is a housing 10 made of stainless steel (shown in FIG. 4 with the side wall removed), which has a door 12 which provides a closure for an opening through which the baskets 14 containing the groups of charged battery plates to be dried may be lowered into the chamber 16 for drying. At the rear of the chamber 16 there is a blower, designated generally 17, for forcing hot air from the rear down into the chamber 16 in the direction of the arrow A shown. There is a heater, designated generally 21. Below the baskets, there is another chamber 22 which has an upper bed 24, preferably being of stainless steel, which extends from side to side within the chamber 22, but does not extend from the front to the back of the housing 10. Water is introduced at the bed's upper end 23 through inlet piping, 26.

Figure 4:
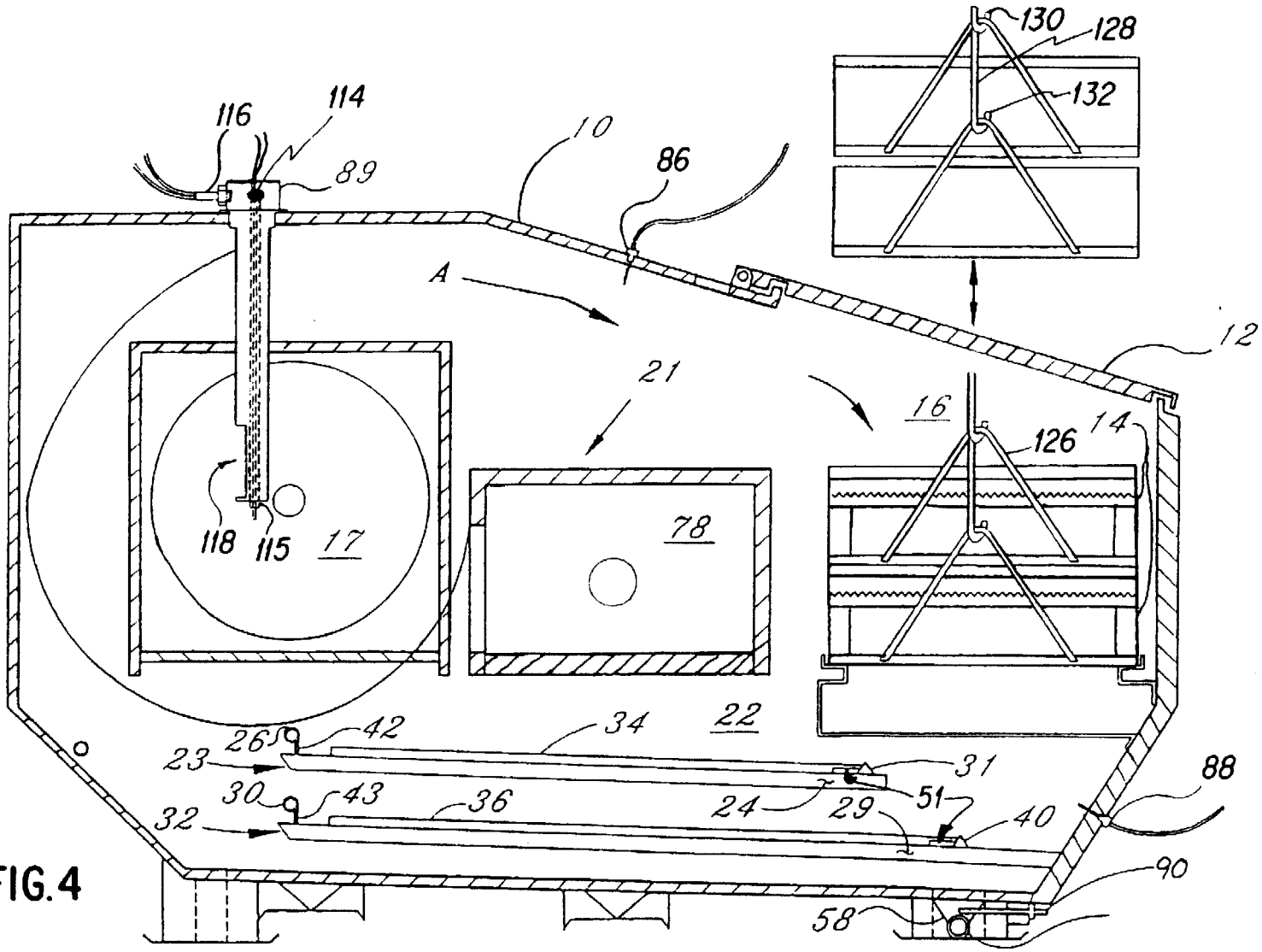
FIG. 4 is a vertical section of a machine in accordance with the present invention taken as in FIG. 1.

There is also a lower bed 29 positioned below the upper bed and extending forward of the upper bed as illustrated in FIG. 4. The lower bed also has water introduced by means of piping 30 at its upper end designated generally 32. Positioned running the length of each of the beds are a plurality of angled strips 34, 36 having their longitudinal bottom portions welded to the stainless steel beds 24 and 29 respectively, so that there is formed a plurality of flat channels designated generally 35 therebetween as clearly illustrated in FIG. 5.

Figure 5:
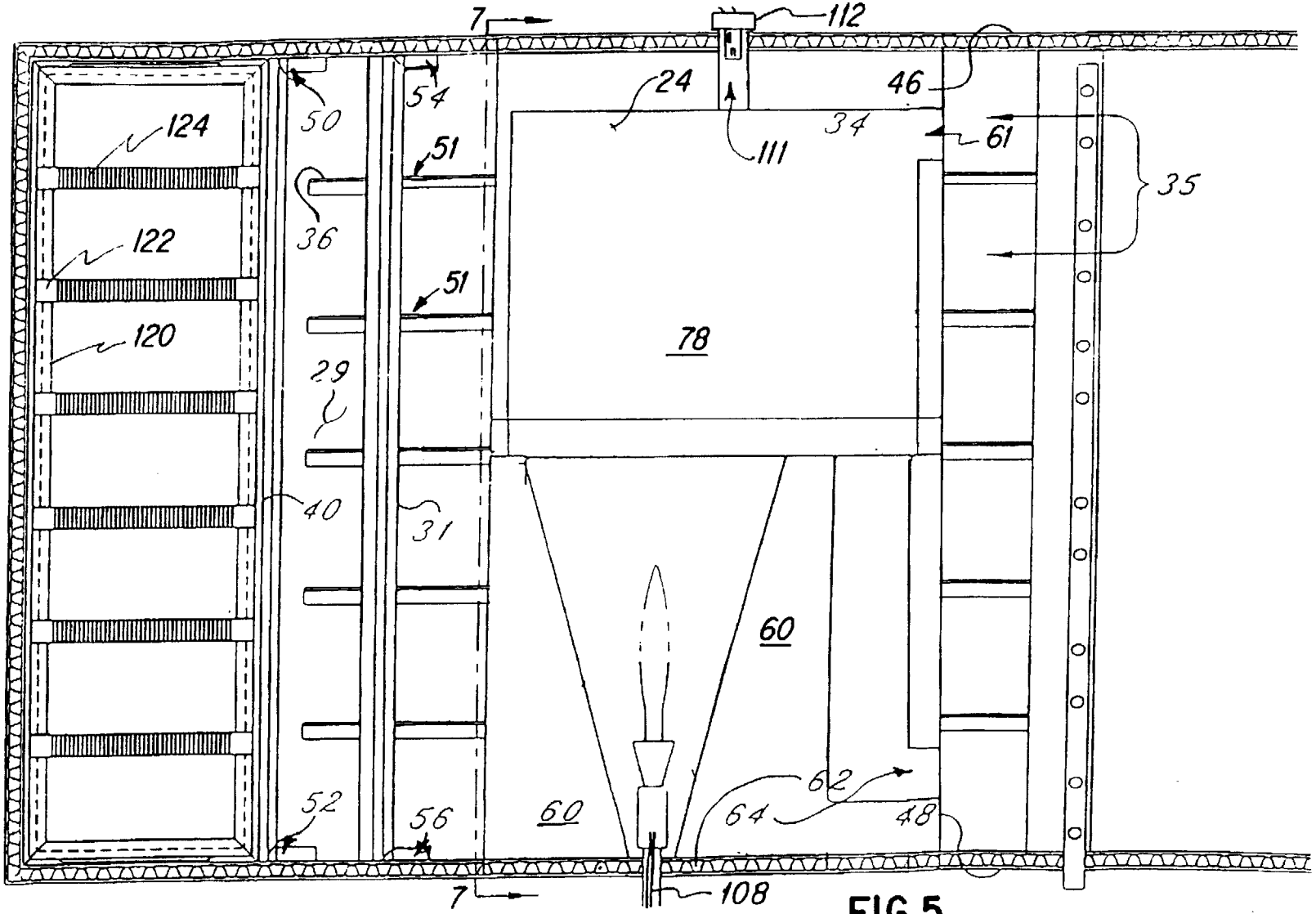
FIG. 5 is a top view, partially is section, taken as a view similar to that shown in FIG. 2 of the prior art.

Across the bottom edge of each of the beds is another angle shaped member 31, 40 respectively positioned and dimensioned as shown in FIGS. 4 and 5.

The pipes 26 and 30 run along the entire width of the beds 24 and 29 respectively, and have a plurality of holes for introducing the water. In order to cut down on the splashing of the water, the holes communicate with flat webs 42, 43 respectively, so that the water introduced through the pipes runs down the flat webs and onto the upper surfaces of the beds without splashing.

In operation, when the air progresses from the chamber 16 to the chamber 22, it would normally tend to blow the water up the sloped beds 24, 29 and indeed the slopes are arranged at an angle such that the water will eventually build up on the beds so that the static head will overcome the force of the air blowing the water up. Most preferably, the water is introduced and the air is moved at a rate such that the contact between the air and the water is just below that which would cause "white caps". The desire is to keep water particles from being entrained in the air. The angle members are positioned and arranged, as are the beds themselves, so that water collects along the members 31 and 40 FIG. 4 and exits at the edge closest to the walls 46 and 48 as, for example, in the spaces or slots designated generally 50, 52, 54 and 56 in FIG. 5. The flow of water and the spaces are dimensioned and designed such that the water simply runs down the sides, rather than dropping as a waterfall. A waterfall would cause undesirable splashing and water entrainment in the air. The water is collected in a trough, 58, FIG. 4, from which it leaves by means of gravity into a sump (not shown) and is pumped back to a cooling tower to be thereafter reintroduced into the machinery.

It will be appreciated that the two beds of flowing water create a much greater surface area for heat transfer than the flat beds themselves, due to the counter flow temperature gradient.

It will also be appreciated that the removal of the spray nozzles means that there can be higher wind velocity.

The entire chamber is insulated, which makes it possible to operate at a higher temperature and, therefore, reduce drying time of the prior art devices.

The long fins, or angled members 34, 36, keep the water controlled, that is, keep it from scooting out of the way when the blower is on, and thus keep a wetted surface on the beds.

Slots designated generally 51 on the bottom of the angled members allow the water to exit from each channel.

Turning now to the heating and blower arrangement, the heating chamber 78 is insulated on all sides, FIG. 5, with the exception of several ports. An internal wall 60 in the fire box, FIG. 5, contains the heated air and channels it to approximately the center of the fire box heating chamber 78, where a portion of it continues to move forward and out the port, designated generally 61 in FIG. 5. The remainder is channelled around the wall 60 and exits through the port, designated generally 64. The heated air passes into the chamber 66 FIG. 7 from whence it is sucked into the suction ports designated generally 68 and 70 of the twin rotor blower designated generally 17.

The blower blows the air out through the orifice, designated generally 72. The panels 74 and 76 engage the side walls and top of the housing forming chamber 16, to form an expanding chamber for introducing air on top of the plates.

While there is now a greater cubic feet per minute possible, the air tends to stay in the closed loop in the machine. In the prior art, the baffle plate tended to divert the air out of the machine. Therefore the top front door had to be closed during preparation prior to introduction of the combustible gasses. Accordingly, purging was necessary because of gas leaks and human error. When the machine was idle in the prior art, the purge time was two minutes. The purge time in the present machine is approximately twenty seconds. In this machine, all one does is turn it on and flush it with four volumes of air for that preset time. The machine is set to go to a lower speed, so that there can be combustion when the operator hits the start button to start the process. Once the door closes, the main blower comes on and the drying process starts.

The machine measures the temperature below the plates by the thermocouple 88, FIG. 4. Once that gets to 135° F. (below that there is insufficient evaporation from the plates) water begins to flow in at approximately 75° F.

The temperature going into the plates is measured by the thermocouple 86, FIG. 4. When these temperatures are close, the plates are dry. Normally, there is a 10° F. differential at the point at which the plates are just about dry. This can be adjusted. This prevents thermal "run away", wherein the machine thinks the plates are dry and shuts down.

By means of the thermocouple 90, the water temperature leaving is measured at 115° F. to 120°. This reading is used to modulate the water and, therefore, the cooling flow.

The process of evaporation extracts 35° to 40° F. of heat. Water leaving the plate, gets condensed into cooling water as previously stated, and goes to the cooling tower.

When the plates are dry, the machine shuts down to a "ready to process" phase, in which condition there is a pilot light still lit. The door then opens automatically.

A number of items of improvement over the prior art are in the most preferred embodiments. For example, a quartz tube 110 is put over the flame rod 108 to keep it hot, that is above 212° F., and thereby prevent condensation which would inhibit electrical grounding. See FIG. 9.

The exhaust gas outlet stack 89 FIG. 4 is placed near the rear of the machine proximate to the drive shaft of the blower, that is, at the lowest pressure point. Thus, the exhaust gas at this point is close to "zero" pressure, whereas the pressure at the outer periphery of the blower is 1.5 inches of water. Note in this regard that if the exhaust stack was placed at the top, there would be minus 1.5 inches at the shaft and air could be sucked in. In the prior art, the exhaust stack was just after the spray nozzles on the side, and on the suction side of the main blower, before the mist eliminator. Any place in the prior art machine that there was a blockage, there was also a pressure drop. This created an even more negative pressure within the prior art machine and, therefore, the stack required a damper with a counter weight on the top (see 47, FIG. 1 of the prior art) to make sure the pressure did not go negative. Also the machine required a sensor to shut it off.

Herein, the pressure is read right at the fire box and thus, the machine senses if the box is going to negative pressure. If so, the machine automatically shuts off the fire.

A zero governor is connected to the manometer to mix the gas and air.

Since the rear explosion door of the prior art machine has been eliminated, this also eliminates the prior art rear door seal, which was a problem insofar as there was air leakage around the door. This would mean that additional oxygen would get in and cause damage to the product being processed.

The machine is designed to run the burner at 100% perfect ratio, so that all the oxygen is burned. This is possible so long as air is not sucked in from the outside. Thus, it is necessary to maintain the pressure so that the machine does not go to negative pressure.

To aid in this, an air seal is provided around the top front door, which is maintained in tight communication with adjoining upper walls by air cylinders on the sides of the door. These air cylinders keep pulling down against the door in order to maintain the seal.

The controls are set up such that the instant the flame rod says there is no flame, the front door opens.

Figure 6:
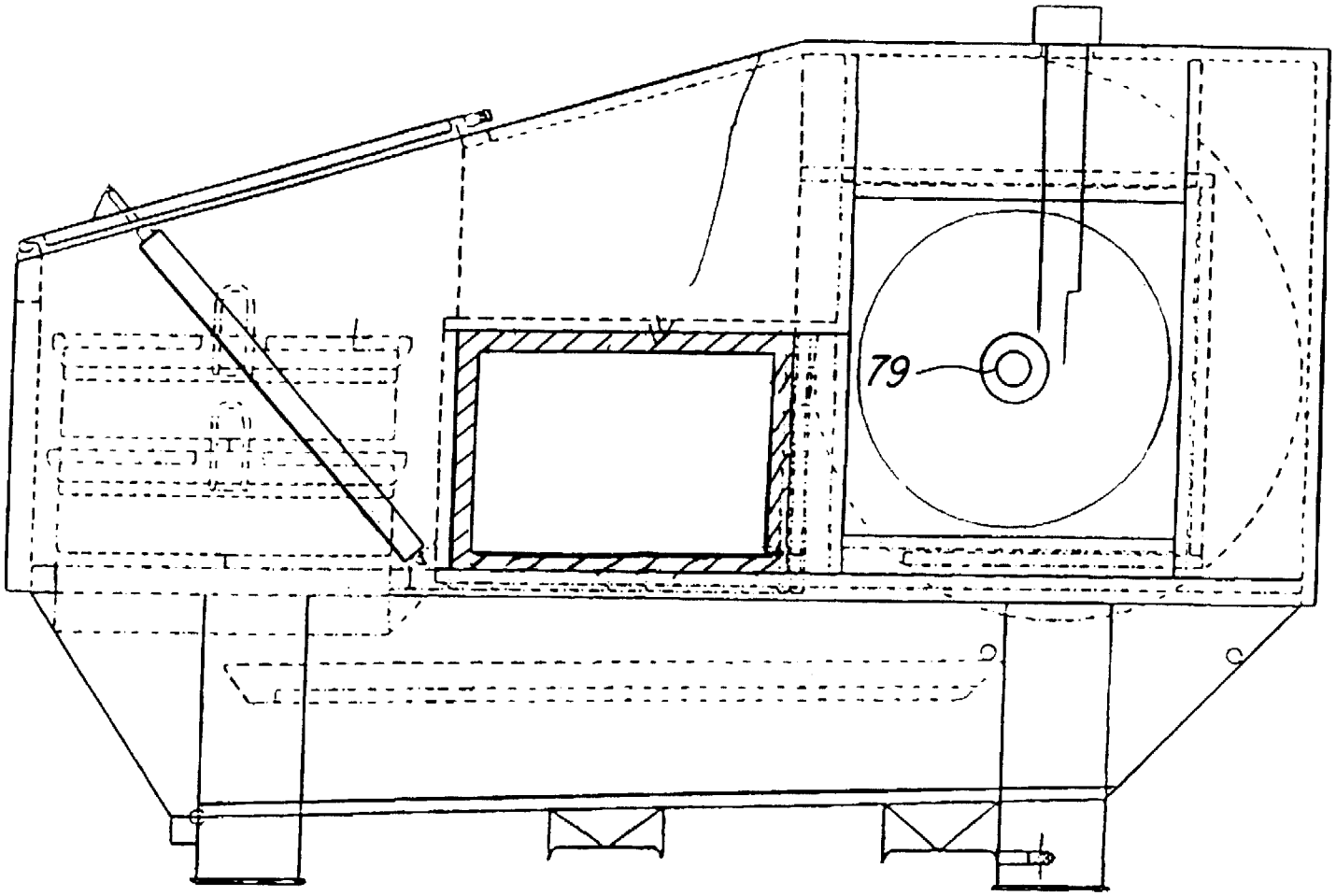
FIG. 6 is a view similar to FIG. 4, except it is taken from the opposite side and is an external elevation.
Figure 7:
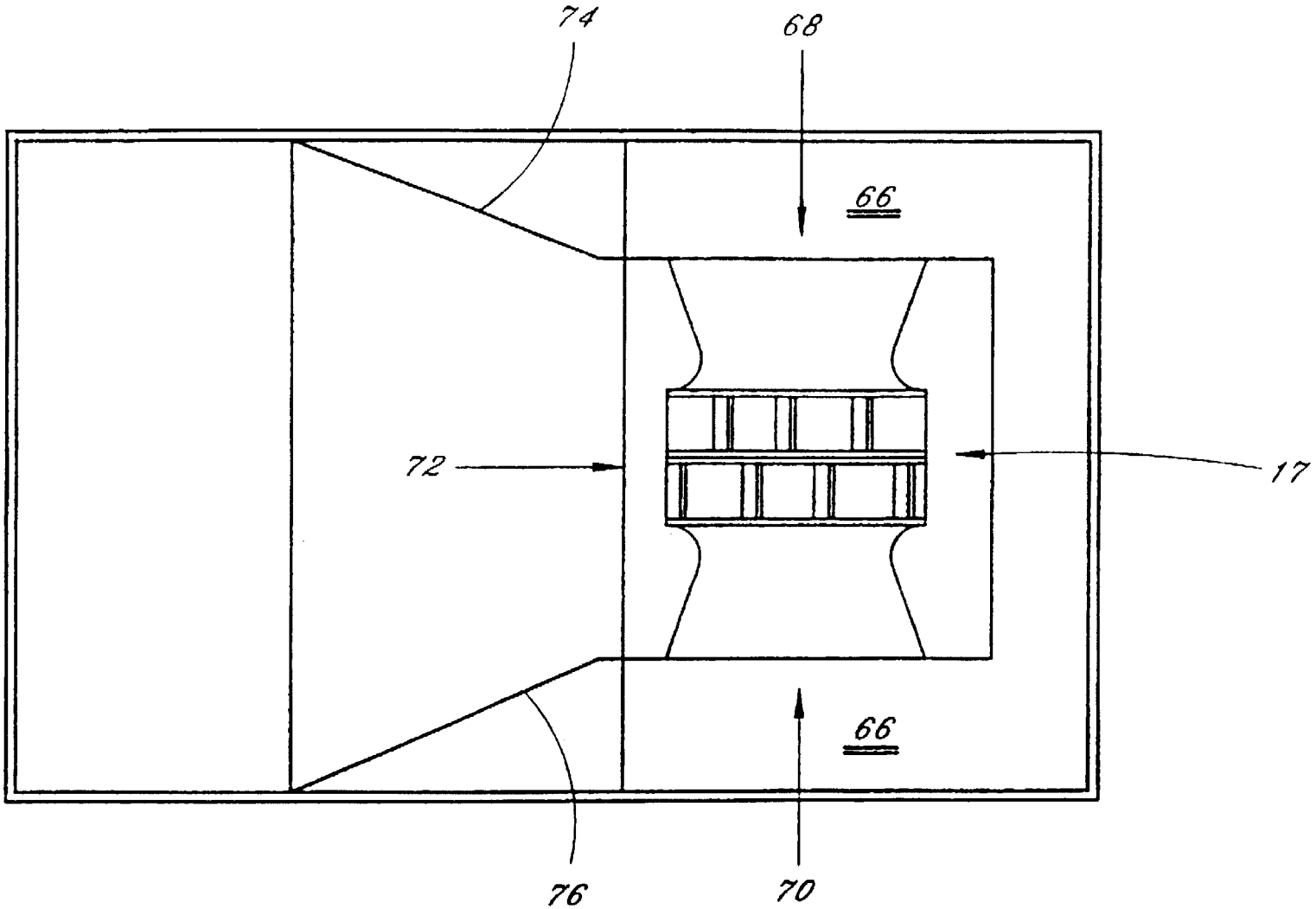
FIG. 7 is a front elevation taken as indicated by the lines and arrows 7—7 in FIG. 5.

The inboard bearings of the prior art have been replaced with outboard bearings 79, FIG. 6 on the blower, thus extending their life.

In the prior ant, the water discharge was 6 inches from the input. In the present machine, it goes the length of the machine away from the output.

Some salient features of this dryer are as follows:

- ⅙ th of the energy used by the blower as compared to the prior art.
- No spray nozzles for cooling of the water and no mist eliminator. The hot moist air comes in direct contact with the water film on the beds which cools and condenses it, and the condensed moisture is entrapped into this film.

Because of the limited surface area of the water film, the hot gasses leaving the plates are not excessively cooled and thereby reducing the load on both the cooling water and the burner.

The water is not turned on until a given temperature has been reached; for example, 135° F. The flow can be modulated down to almost no flow of water at the end of the cycle (when there is very little moisture to remove) and the exit water temperature most preferably never goes below 115° F.

In the morning the machine is turned on. The door is already open. The process blower for the furnace comes to top speed with the butterfly valve in the air input of the burner open, to automatically purge the machine of combustible gases in approximately 20 seconds. Then the butterfly valve closes to the low fire position, the main process blower turns off, and then the pilot gas and ignition transformer turn on simultaneously for about 15 seconds. If ignition is successful, plates can be loaded. When it is turned on, the main flame is growing. Approximately five seconds later, the operator can then press the start button which will automatically close the loading door. After about ten seconds the main burner comes full on. The process then continues until the temperature reaches above 180° whereupon the water is turned on. This permits a rapid heating up of the product without the unnecessary cooling of the drying gases. At that point, the water is being drawn out of the drying environment and this continues until the effective wet bulb temperature starts to rise up to approximately 170° F. From there the temperature rises quickly which indicates that the product has no moisture left to cause cooling of the process air. When the process air below the plates reaches 176° F. the plates are considered dry; although in practice the spread can vary. The process then automatically stops, and the loading door opens up to permit the operator to remove the product.

The drying process is controlled by the differential between the drying temperature and the wet bulb temperature. As long as the hot moist air contains moisture there is an excellent heat transfer between the water film and the drying gases. Once the water has been removed from the product, the air becomes dry and the actual heat transfer becomes quite limited on the water film.

The stack has been moved from the wet section to an area close to the entrance of the blower; which is the low pressure portion of the machine. The orifice is so positioned as to reduce the amount of hot air going up the stack. In actuality, the temperature of the exhaust gases is slightly less than the gas below the drying elements. The stack 89 contains a fixed reduced orifice thereby producing a positive pressure in the chamber.

Insofar as the energy conversion is concerned, note the following comments:

The rate of heat input to the plates is governed by the temperature and flow rate of air across the plates. Heat capacity of air or water vapor is about 0.144 Btu per cubic foot per ° F. temperature change. For example, to raise one cubic foot of air 10° F. requires 0.144 Btu of energy.

However, to convert liquid water to one cubic foot of water vapor requires 37 Btu. This is 256 times more energy. Therefore, the process of changing water to vapor or liquid to vapor dominates the heat transfer process. A small decrease in the temperature of 100% water vapor saturated air translates into a large transfer of energy. For example, changing the temperature from 155° F. to 150° in one cubic foot of water vapor saturated air releases 1.34 Btu per cubic foot of air. To get the transfer of the same amount of Btu to air which is not 100% water vapor saturated, you would need a temperature change of 93° F. per cubic foot of air.

Bearing this is mind, it is theorized that there is a large temperature difference above and below the plate where the heat content of the air is used to evaporate the water from the plates. Whereas the temperature change of the air to condense the water vapor leaving the plates is much smaller because a much smaller change in 100% relative humidity (RH) air releases the large energy of condensation.

The energy profile of the dryer may be understood by reference to conditions in the chambers. Below the blower 155° F., 100% RH air is mixed with hot combustible air exiting from the fire box. The resulting air becomes 200° F. 35% RH air leaving the blower and moving into the chamber 16. In the chamber 22 right under the basket there is 160° F. at a higher RH (relative humidity). As the air travels above the water, to the rear of the chamber 22 there is a drop to 155° F. 100 RH air.

Notice that the first process of the plate evaporation requires a 25° F. to 35° F. change and the second process of condensation requires only a 2° to 7° F. change; even through the same amount of energy is being transferred. The total energy transferred via the air is proportional to the temperature change of the air. The total reheat requirement is equal to the sum of the ranges.

The last consideration is the CFM (cubic feet per minute) of the main blower air. This is limited to the speed at which white caps are formed, since with the creation of white caps comes water droplets which are reintroduced into the plates.

A wind velocity meter measures the speed of the air past the cooling beds and changes the speed of the impeller so that the air speed remains constant. This means one can always dry as fast as possible. If there is a light load in the machine, the blower runs slower. If the plates are packed, it runs faster.

When the difference between the temperature of the air entering the plates and the temperature of the air leaving the plates goes below a certain point, the plates are declared dry. By keeping the exit water temperature constant at 115° F. (a temperature which was determined experimentally), the automatic dry temperature differential mentioned above can be detected. This is greatly different from the prior art in which, if the cooling water is too cold, the temperature never gets to the autodry differential. If on the other hand, one would back off on the water to too great a degree, the temperature reading would tell one that the plates were dry, when in fact they weren't. It is theorized that this is because one is measuring a very small level of moisture in a very active environment.

The prior art Tiegel machine had no insulation surrounding the fire box. This lead to uneven heating of the plates, because the plates near the fire box were heated both with a radiant heat from the fire box and with hot air. Thus, the plates near the fire box got too hot and the plates far away were too cold for maximum drying speed. Consequently, Tiegel recommended 180° F. as the most preferable operating temperature, while it is now possible to recommend a drying temperature of 200° F. as a result of insulating the fire box. This allows a process temperature twenty degrees higher than with the Tiegel dryer and thus allows a faster drying of the plates with no decomposition or auto-ignition problems.

Figure 8:
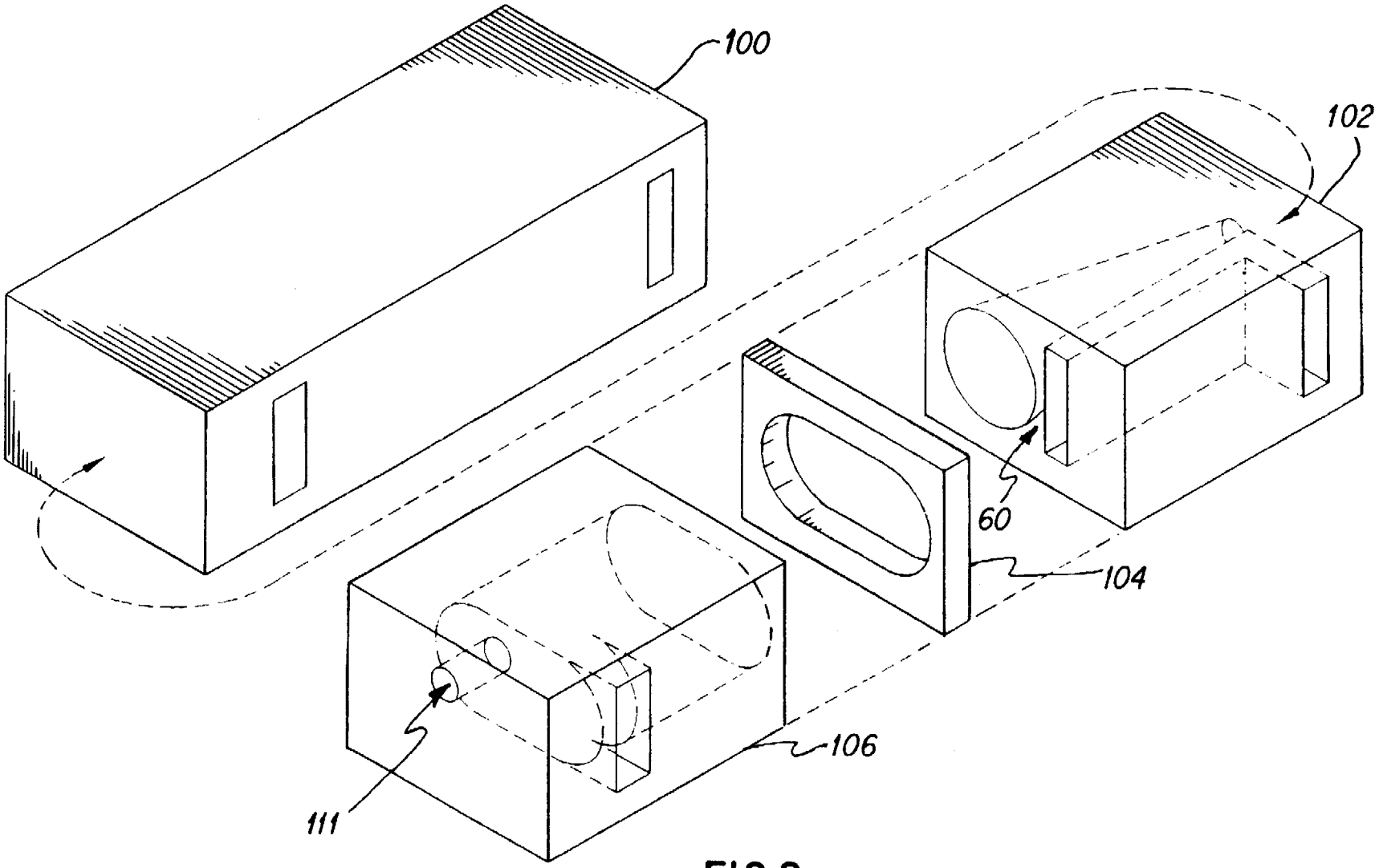
FIG. 8 is an exploded perspective view of a portion of the apparatus comprising the firebox shown in FIG. 5.

An exploded view of the firebox construction is shown in FIG. 8. Therein it will be noted that the box has been made in separate parts which are assembled and insulated, and then slid into a stainless steel sleeve 100. The parts of the firebox comprise the input section 102, the gasket 104 and a terminal section 106, all made of a pre-cast, heat-tolerant material. The sections are assembled together and wrapped in insulation (not shown), then slid into the sleeve as shown in the assembled condition in FIG. 5. Therein, the insulation is designated 62.

Figure 9:
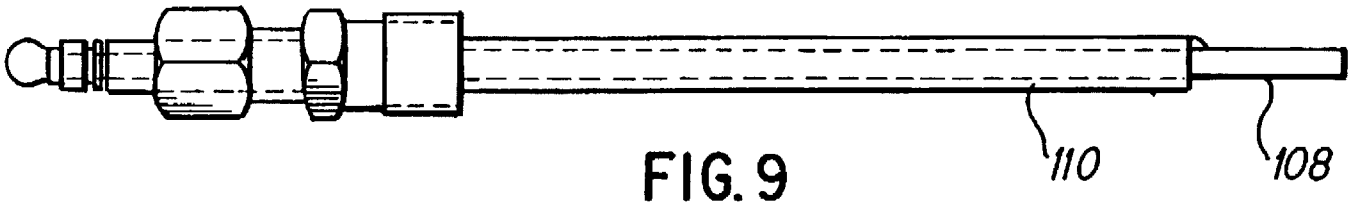
FIG. 9 is an enlarged view of a portion of the apparatus comprising the flame rod shown in FIG. 5.

At the input section, there is a flame rod, 108, FIG. 9. A portion of the flame rod is covered with an extended hollow quartz tube 110. It is theorized that the way the flame rod works is that one impresses a 250 AC voltage on it. The gas within the flame coming out of it is considered ground. As a flame is being lit, it ionizes the gasses and, because the wire is so small in surface area compared to the ground surface, it becomes a semi-rectifying circuit. It is this half-way rectification that is being monitored. If it becomes an AC (alternating current) wave, the monitoring circuit automatically rejects it and shuts the gas line down. In the previous art, what normally happened was that the porcelain insulation at the upper end would become wetted with moisture, and this would then form a circuit between ground and the high voltage. The AC would not be rectified, and, therefore, shut the gas line down. By means of this quartz tube, I have lengthened the leakage path.

Figure 11:
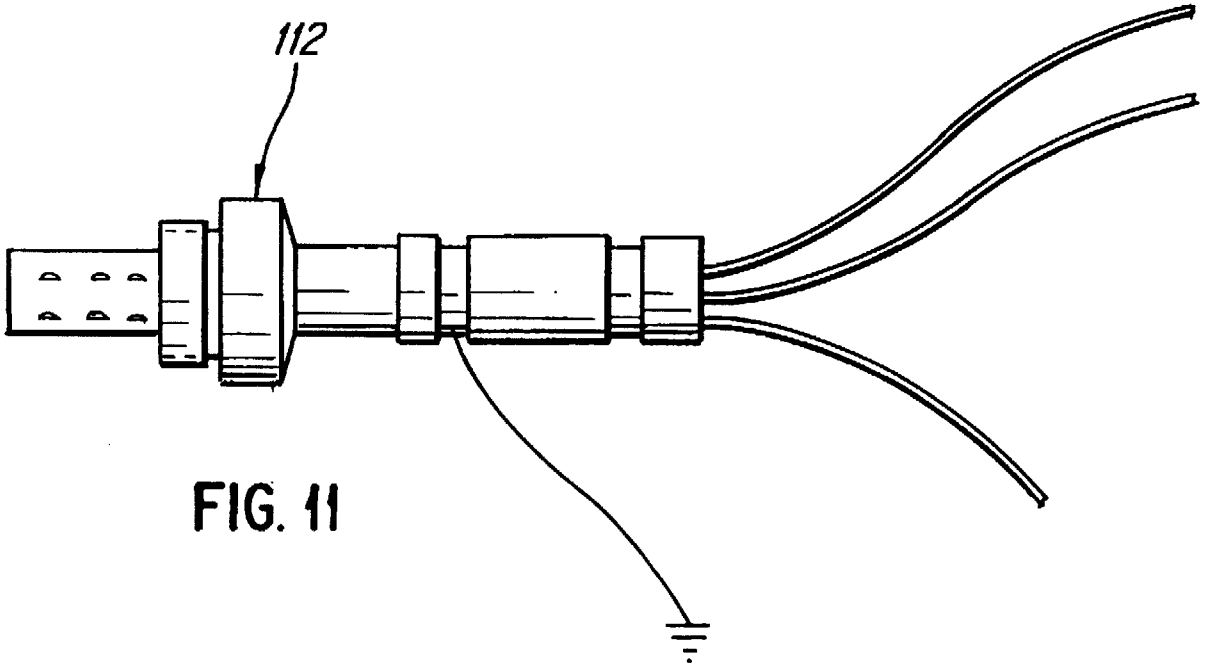
FIG. 11 is an enlarged view of a portion of the apparatus comprising an oxygen sensor.

At the other end of the firebox, there is a hole designated generally 111 through which is mounted an oxygen sensor 112, shown in enlarged view in FIG. 11. Such a sensor is very sensitive to both oxygen and carbon monoxide. Once there is a carbon monoxide present in the atmosphere, the voltage reading rises quickly. With a 60 millivolt reading, one can obtain zero percent oxygen.

A similar oxygen sensor 114 is also provided in the stack 89, FIG. 4 in the end of the tube 115 which is open proximate to the axis of the blower. The sampling tube 115 communicates through the bottom of the stack and is opened all the way up to the sensor 114 for purposes of measuring oxygen content. This provides the worst possible reading, since it is located proximate to the axis of the blowers 17 and, therefore, would be sensing the most negative pressure.

Another sensor 116 is mounted in a hole in the top of the stack 89 for the purpose of sensing temperature in the exhaust gas in case of a thermal runaway. At this point it will sense hot exhaust gas and shut the machine down.

The positioning and design of the stack 89 has been changed from that shown in the prior art, as will be appreciated from viewing the position of the stack 44 in FIG. 1 and that of the stack 89 in FIG. 4. The stack has been moved away from the blower/heat entrance. Furthermore, a restricted opening, designated generally 118 is provided also oriented away from the heat entrance from the firebox 78. The restricted opening 18 is positioned so that it does not entrain the hot gasses coming from the burner. This restricted opening, and positioning prevents the monitor 116 from picking up an erroneous reading of a thermal runaway.

The use of these sensors is for monitoring the process. The sensors 112 and 114 are standard parts used in automotive gas exhaust monitoring systems.

One step in the process is to remove the water vapor from the air as the water vapor saturated air leaves the plates. The water vapor removal rate must be as fast as the water vapor leaves the plates. If it is too slow, the drying process slows and eventually stops, since the air becomes saturated with water. The new machine takes an entirely different approach in this step. Only a small temperature drop is required to remove an inadequate amount of water vapor via condensation. Any further cooling of air is a fruitless exercise. Thus the new dryer uses just enough cooling to maintain evaporative equilibrium. It has been found that a falling film of water introduced at 80° F. to 85° F. and leaving at 110° F. to 115° F. was quite adequate. The only requirement was that all the air needed to be cooled by similar amounts. Otherwise, the hot air would not cool and condense out the moisture; thus producing a mixed result. Therefore, most preferably the machine should contain a second falling film in the middle to further improve the drying speed.

Flow is modulated to keep the water exit temperature from the dryer at 115° F. In order to refine this process, cooling is not started until the temperature of the air leaving the plates is above 135° F. Below that temperature, the plates are not hot enough to release significant amounts of moisture. Cooling at the start of the drying cycle only increases drying time because it takes longer to come up to process temperature. Modulated flow of cooling also decreases the time to come up to process temperature and allows a more accurate determination of dryness. Therefore, plates are dried just enough. Historically, plates were always overdried just to make sure. Plates that were too wet, had to be formed, washed and dried all over again.

In the prior art, removing the last bit of moisture took over half the dry cycle time. This occurred because water droplets from the cooling spray nozzles were constantly being reintroduced into the plates being dried. The new dryer never creates water drops to start with. The falling water film clings to the cooling pan. The only way to create water drops in the new dryer is to move the air fast enough to create "white caps". Therefore, increasing cubic feet per minute can actually increase drying time, by creating "white caps". Thus, the air speed is set so that no "white caps" are formed.

The new dryer produces a product that has half the moisture content, in one third the time. This is achieved, in part, by not creating water droplets in the dryer that can be blown around and reintroduced into the product being dried. Further, it has been observed that the lead oxide content is also cut in half. This leads to a superior quality negative plate. The lower lead oxide level stems from faster drying, a tighter no leak oven and "on" air/gas ratio burning at a low firing rate. The new dryer also achieves this by using approximate atmospheric pressure as the reference for the zero governor. Since this approximate atmospheric pressure changes very little, the zero governor can continue to accurately dispense gas with a pressure differential of less than half an inch water column. Ideally, one would want the gas pressure at the burner mixer to be equal to the pressure in the combustion chamber. The control, or governor in the gas input line, monitors this and controls it. The old dryer needed a pressure differential of more than 3 inches water column. If the damper got stuck in the closed position, the machine would pump in too much gas, creating explosive conditions.

Since the loading door is the explosion door as well, and the blower shaft is mounted on the flange style outboard bearing, the two major sources of oxygen intrusion have been eliminated. The oxygen usually would get sucked in via the main blower shaft where the pressure is the lowest and the seals are sloppy. The new dryer has the exhaust port right at the main impeller shaft. This eliminates the need for a damper and allows the fire box to run near atmospheric pressure. This also gives a very accurate "on" ratio burning, especially at low firing rates.

The machine is more user-friendly for the following reasons:

1. Auto Pilot. When an operator turns on the machine, the dryer automatically purges the whole oven of any combustible gases in less than 30 seconds by having the loading door open, the main blower (10,000 CFM) on and the combustion butterfly valve open. After the purge cycle is complete it automatically turns off the main blower and drives the butterfly valve to low fire. Once this happens the pilot is ignited automatically. The moisture proof flame rod assembly prevents false lack of flame signal due to moisture. If ignition is successful a green ready light comes on. The dryer is ready to process plates with the turn of just one switch.
2. Auto Process—To process plates the operator loads them into the dryer and hits the process starter button. Then as the loading door automatically closes, the burner comes up to high fire. When the loading door is completely closed the main blower automatically comes on line. A white light comes on letting the operator know the plates are dry and that the loading door will open in less than 30 seconds indicating the plates are ready to unload. There is no process clock to set, because the dryer always knows when the plates are just dry enough. The operator can dry plates with the press of a button. There is no main gas valve handle to move or explosion door to close or loading door to latch.
3. Autodry/Auto Cool—These features work together to dry the plates as fast as possible to the same level of dryness every time. They keep cooling and gas consumption to a bare minimum. "Auto dry" determines the exact point of when the plates are dry and "auto cool" introduces just enough cooling to remove moisture as it leaves the plates. Cooling is reduced as the amount of moisture leaving the plates declines. Auto dry automatically compensates for poor basket packing by increasing the dry time. It also adjusts for changes in product type. The operator can choose the level of dryness he wants by changing the "autodry" set point. Maximum production speed is achieved all the time. There is no guessing at proper drying time.
4. Automatic adjustment of blower speed to compensate for back pressure differences when one changes from group drying to cassettes or rack drying. The wind speed is always just below white cap formation speed. This further maximizes drying speed of what is being dried.
5. The control box displays process air, exhaust stake, "auto dry" and water outlet temperature which allows the operator to detect and correct malfunctions, such as lack of cooling, without the machine shutting down while processing plates. This eliminates unnecessary product loss. Cooling tower status is also indicated.
6. A white light turns on, warning the operator that the loading door will be opening in less than 20 seconds.
7. Quiet machine. Only 3 dB (decibel) over factory background noise.
8. Low profile machine. Bottom basket level to clear loading entrance is less than 50" from ground level.

MORE UTILITY EFFICIENT

1. Electric: 3.0 KW
2. Gas: 250,000 Btu/hr
3. Water: 420 Gallons/hr.

When one factors in the three-fold increase in drying speed, the utilities become the equivalent of 1.0 KV, 83,000 Btu/hr. and 140 gallons/hr.

MORE MAINTENANCE FRIENDLY MACHINE

1. No mist eliminator screen to clean.
2. No spray nozzles to wear out or clog.
3. No exhaust port damper to stick.
4. Main blower bearing mounted externally.
5. No re-bricking. Insert firebox modules.
6. No explosion door seals to maintain.
7. No fault finder box.
8. No freon bulb to calibrate or replace.
9. No paint. All fixed parts 316 stainless steel.
10. No basket baffle plate.
11. No basket seal to maintain.
12. No explosion doors to maintain.
13. No zero governor feedback tube to clog zero governor with moisture and firebox material.
14. No fan belts.

It is further theorized that this machine is much more efficient because, as one can see from the accompanying psychometric chart, FIG. 10, by going to the higher temperatures, namely 180°, the amount of humidity that can be put into the pound of dry air goes up quite rapidly. It is virtually a logarithmic function, which flattens out as one comes down to approximately 130° to 120°. Cooling below this point serves a very limited purpose. The change from a vapor state to a liquid state happens at the same temperature and, therefore, a 3° change is able to transmit alot of energy into the water.

In summary, one wants to have the air hot enough in temperature in order to load it up with sufficient moisture and cool it just sufficiently enough to condense the moisture out without unnecessary cooling. As one can see, the drop of temperature from 173° down to 170° would change the humidity from 0.48 lbs. of water per lb. of dry air, down to less than 0.43. This compares to a 2.5 fold difference if one were at 130° temperature where there would be approximately 0.14 lbs of water per pound of dry air falling down to only 0.12 lbs. of water per pound of dry air at 130° temperature. Thus, the process and machinery work up in the 173 degree region in order to increase the efficiency. From this it can be seen that in the prior art they had to decrease the air temperature to keep the plates from decomposing as they would at a temperature over 220°. Now we can uniformly dry at essentially 198° to 200°.

The maximum use and efficiency of this apparatus has been further increased by redesigning the baskets and the method and means by which they are inserted and withdrawn. FIGS. 4 and 5 show the basket in elevated and plan views. Each basket 14 consists of an open frame which has an internal ledge 120 upon which are placed a series of tubular structures 122 which are essentially rectangular in cross-section. On the upper surfaces 124 there is a plastic strip having transverse serrations. The serrations are used to space battery plates longitudinally. The tubular structures 122 are movable along the basket ledge 120 in order to accommodate various widths of battery plates. It is understood by those skilled in the art that battery plates have tabs extending from them and that these tabs can be placed within the individual serrations in order to space the plates. Each end of the basket has a stainless steel inverted "V" shaped wire member 126 round in cross-section welded thereto; so that the upstanding apex of the "V" is located substantially on the center line of the basket. In order to withdraw the baskets, a rod 128 which has two hooked-shaped members 130, 132 welded to it is inserted down between the outermost edge of the basket and the inside sidewall of the housing 10. This rod is then rotated 90° and lifted upwardly so that the hooks engage the respective apexes of the "V" shaped handles of the baskets 14. The hooks are placed a greater distance apart than the upstanding "V" shaped apexes so that the top hook engages first and begins to lift the top basket before the bottom hook engages and lifts the bottom basket. This basket design not only aids in air flow, but also in maximizing the number of plates that can be placed in a standard sized vessel. Furthermore, the basket is so dimensioned that there is only a slight clearance for the rods 128 to come down and engage the hooked-shaped members. This also aids in removing the baskets in that they will not, in practice, cock and jam upon withdrawal.

We claim:

1. An apparatus for drying charged battery plates, comprising:

a housing capable of maintaining a positive gas pressure within it;

a drying chamber within said housing having means for supporting battery plates to be dried in a position to allow gas to be moved past the plates;

a combustion chamber within said housing for providing hot, dry, substantial oxygen-free gas to a blower means; which blower means is provided to blow the gas past the plates, to effect drying of the plates by removing moisture therefrom;

means for providing a flowing sheet of cooling water to contact the gas exiting from said plates and condense out the moisture removed from the plates during drying; and means to maximize the thermal efficiency of said apparatus in drying the plates and minimize the energy necessary to raise the temperature of the drying gas, by controlling the temperature within said housing whereby heat is used primarily to dry the plates and minimally to reheat the gas from the heat lost due to said condensation of moisture from the gas.

2. The invention of claim 1 wherein the combustion chamber comprises a firebox having a casing containing removable inserts.

3. The invention of claim 2 wherein the removable inserts are configured to provide communicating chambers channeling the hot, dry air to two exhaust ports spaced from one another proximate to the walls of said housing.

4. The invention of claim 2 wherein the inserts also comprise a spacer therebetween and wherein the inserts and spacers are insulated from the firebox casing.

5. The invention of claim 2 wherein the firebox has a flame rod with a quartz tube extending around said flame rod over the greater portion of the length of said flame rod.

6. The invention of claim 2 wherein an oxygen sensor communicates with said firebox.

7. The invention of claim 1 wherein the means for providing a flowing sheet of cooling water, comprises: at least one bed positioned below said plates in said housing on an angle to provide for gravity feed of said water; said bed having fins thereon directing the water into separate webs thereof.

8. The invention of claim 7 wherein water is introduced along an upper portion of said bed by a header pipe having a plurality of holes therein communicating with a vertically upstanding web.

9. The invention of claim 7 wherein said bed terminates in a retaining wall and slots are provided in said fins to allow water to exit off of said bed and said webs.

10. The invention of claim 7 wherein said water drains into a trough and a temperature sensor is positioned in said trough to measure the temperature of the water exiting therefrom.

11. The invention of claim 1 wherein said blower means comprises blowers mounted on a shaft, said shaft being supported by bearings mounted externally on the housing.

12. The invention of claim 1 wherein a means is provided to measure the temperatures above and below the plates comprising thermal couples positioned in said housing above and below the plates, respectively.

13. The invention of claim 1 wherein said blower means comprises at least one blower mounted on an axis positioned downstream of the hot gas exiting the combustion chamber, and a stack is provided positioned posteriorally of the axis of the blower, said stack having a restricted opening at its lower end positioned to open to the rear of the housing away from the hot gas exiting from the combustion chamber.

14. The invention of claim 13 wherein a temperature sensor means is provided at the top of said stack exteriorally of said housing.

15. The invention of claim 13 wherein a hollow tube is positioned within said stack having one end communicating with said apparatus at approximately the plane of the axis of the blower means and the other end communicating through the external end of said stack; and an oxygen sensor is mounted in said other end external of said housing.

16. The invention of claim 1 wherein the means to support the battery plates to be dried comprises at least a basket having a ledge therein upon which are positioned adjustably movable racks to retain said plates.

17. The invention of claim 16 wherein said racks have serrated upper surfaces.

18. The invention of claim 16 wherein said baskets have handles thereon comprising inverted V shaped rods fixedly attached thereto; and removal means are provided to engage said V shaped handles to lower said basket into said housing or remove said basket from said housing.

19. The invention of claim 18 wherein said means for lowering or removing comprises a rod having at least one hook thereon, said rod being positioned and dimensioned so as to fit between the inner wall of said housing and the outer wall of said basket and to be inserted therein and once inserted, rotated so that upon removal it engages said V shaped portion of said handle.

20. The invention of claim 19 wherein a plurality of baskets are used in said apparatus and the hooks on said removal means are spaced apart from one another a greater distance than the spacing of the V shaped handles vertically when said baskets are stacked upon one another such that when said removal rods are rotated and withdrawn the upper hook engages the upper V shaped portion of the handle of the upper basket before the lower hook engages the V shaped portion of the lower basket handle.

21. The invention of claim 20 wherein said door means has a door with a seal around the edge thereof mating with said housing to prevent oxygen leaking.

22. The invention of claim 1 wherein said apparatus is provided with a door means for opening into said housing comprising a door being hinged along one edge thereof and having one or more piston and cylinder arrangements attached thereto and to said housing to actuate said door.

23. The invention of claim 1 wherein means are provided to operate said apparatus for drying charge plates, substantially without introducing water droplets into said gas after it passes over said plates.

24. The invention of claim 1 wherein the sheet of water flows in a counter direction to the gas exiting from said plates.

25. The invention of claim 1 wherein there is provided a plurality of sheets of water for contacting said gas exiting from said plates.

26. A method of drying charged battery plates comprising the steps of: placing the charged plates in a drying chamber; providing a stream of substantially oxygen-free drying gas of relatively low humidity directed to pass over said plates in order to effect drying thereof; condensing the water from the gas which has passed over the plates to dry them, by passing that gas over the surface of a sheet of water flowing in a counter direction to the gas without introducing droplets of water into the gas; and maintaining the temperature differential within said method whereby heat is used primarily to dry the plates and minimally to reheat the air from the heat lost due to condensing the water.

27. The method of claim 26 wherein the step of maintaining the temperature differential within said process comprises the steps of measuring the temperature of the drying gas before it is passed over said plates; measuring the temperature of the drying after it has passed over said plates; measuring the temperature of water exiting from said apparatus; and regulating the temperature and flow rate of said sheet of water in accordance with these measurements.

28. The invention of claim 27 wherein the temperature of the water exiting is maintained in the range of 115° to 120° F.

29. The invention of claim 27 wherein the gas flow over the surface of the sheet of water is regulated so that it is below the rate which would cause "whitecaps".

30. The invention of claim 26 wherein thermal runaway is prevented in said machine by sensing the temperature of the hot gas in the blower chamber by passing that gas through a restricted opening proximate to the axis of blowers in the machinery and reading the temperature externally of the apparatus.

31. The invention of claim 26 wherein said drying gas is heated in a confined area and the oxygen content in said gas is measured at said confined area and exiting said confined area.

32. The invention of claim 26 wherein the method of heating and drying plates comprises confining the plates in a closed area which has first been purged of combustible gases and heating the air in said closed area until the temperature reaches above 180° F. and then introducing said sheet of water.

33. A method of drying charged battery plates, comprising the steps of:

placing the charged plates in a drying chamber;

providing a flow of substantially oxygen-free drying gas of relatively low humidity directed to pass over said plates in order to effect the drying thereof by removing moisture therefrom;

condensing the moisture from the gas which has passed over the plates to dry them, by passing that gas over the surface of a flowing sheet of cooling water; and monitoring the temperature above and below the plates as well as the water temperature of the condensed water and introducing cooling water at a flow rate and temperature so as to maximize thermal efficiency in drying and minimize the energy necessary to raise the temperature of the drying gas, whereby heat is used primarily to dry the plates and minimally the reheat the gas from the heat lost due to said condensation.

34. The method of claim 33 wherein the water flows in a counter direction to the direction of flow of the gas exiting from said plates.

35. The invention of claim 33 wherein said method is performed substantially without introducing droplets of water into the gas which has passed over said plates.

* * * * *